United States Patent [19]

Miker, Jr.

[11] Patent Number: 4,688,286

[45] Date of Patent: Aug. 25, 1987

[54] PILLOW HAVING STORAGE COMPARTMENTS

[76] Inventor: Louis Miker, Jr., 6395 17th La. North, St. Petersburg, Fla. 33702

[21] Appl. No.: 861,299

[22] Filed: May 9, 1986

[51] Int. Cl.[4] ..... A47G 9/00

[52] U.S. Cl. ..... 5/490; 5/485; 5/434

[58] Field of Search ..... 5/485, 490, 482, 442, 5/437, 434, 436; 150/112; 383/84, 86

[56] References Cited

U.S. PATENT DOCUMENTS

| | | | |
|---|---|---|---|
| 1,269,276 | 6/1918 | Harris | 5/485 |
| 1,719,040 | 7/1929 | Barol | 150/112 |
| 3,530,487 | 9/1970 | Beer | 5/496 |
| 3,879,775 | 4/1975 | Iwata | 5/442 |
| 4,064,576 | 12/1977 | Threatt | 5/485 |
| 4,192,365 | 3/1980 | Siegel | 150/112 |
| 4,193,152 | 3/1980 | Seibold | 5/490 |
| 4,227,270 | 10/1980 | Rivera | 5/490 |
| 4,309,784 | 1/1982 | Cohen | 5/490 |

*Primary Examiner*—Alexander Grosz

*Attorney, Agent, or Firm*—Ronald E. Smith; Miguel A. Valdes

[57] ABSTRACT

A pillow having storage compartments. The compartments may be used to store suntan lotion, beach, poolside or camping accessories. The stored articles are protected from theft because the compartments are hidden from view when the pillow is in use; specifically, they are positioned on the underside of the pillow so that when the pillow is operatively deployed, the existence of the storage compartments may not be ascertained by visual inspection.

1 Claim, 2 Drawing Figures

PILLOW HAVING STORAGE COMPARTMENTS

BACKGROUND OF THE INVENTION

1. Field of the Invention

The invention relates, generally, to pillow constructions and more particularly to pillow constructions including compartments for the storage of sundry articles therein.

2. Description of the Prior Art

Pillow constructions typically provide no means whereby items desired to be secured from theft can be hidden.

The following U.S. patents disclose different pillow constructions, and are representative of the pillow construction art.

U.S. Pat. No. 1,776,983, awarded to Rotherman in 1930, discloses a combination seat cushion, foot muff, and carrier or receptacle.

U.S. Pat. No. 3,938,569, awarded in 1976 to Hill, discloses a handbag having utility for carrying personal objects, including a cushion.

A 1978 patent to Shields (U.S. Pat. No. 4,116,310), discloses a combination cushion and article carrier.

U.S. Pat. No. 4,185,673 issued Jan. 29, 1980 to Daniello discloses a unitary article carrying bag and cushion.

U.S. Pat. No. 4,468,823 issued Sept. 4, 1984 to Tounjian discloses a spread cover in the form of a sheet of the type used when sunbathing or visiting beach areas, having a pouch like container to conceal valuables.

The art contains no teaching that a pillow construction could be provided with storage pockets, nor does the art contain any suggestions concerning how such a pillow construction could be realized.

SUMMARY OF THE INVENTION

The invention fulfills the longstanding but heretofore unfulfilled need for a structure having utility for the storage of valuables in an outdoor setting.

The structure is in the form of an attractive pillow so that thiefs will not suspect that it contains a storage compartment.

The material used to construct the pillow and its storage means is resistant to outdoor environmental conditions. Moreover, the pillow provides a cushion that prevents damage to the items contained within its storage means; thus, the pillow may even be employed as a comfortable, functional pillow even when it is being used to conceal valuables.

Items of the type which may be concealed within the novel pillow include such items as magazines, cigarettes and lighters, sunglasses, sun tan lotion contaiers, wallets, change purses, keys, watches and jewelry, insect repellent containers, small flashlights, pocket radios, and the like.

The pillow construction includes a pocket flap which is releasably secured to the pillow case with Velcro to secure the valuables against inadvertant spillage.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following description, taken in connection with the accompanying drawings, in which.

Similar reference numerals refer to similar parts throughout the several views of the drawings.

DETAILED DESCRIPTION OF THE PREFERRED EMBODIMENT

Figure 1:
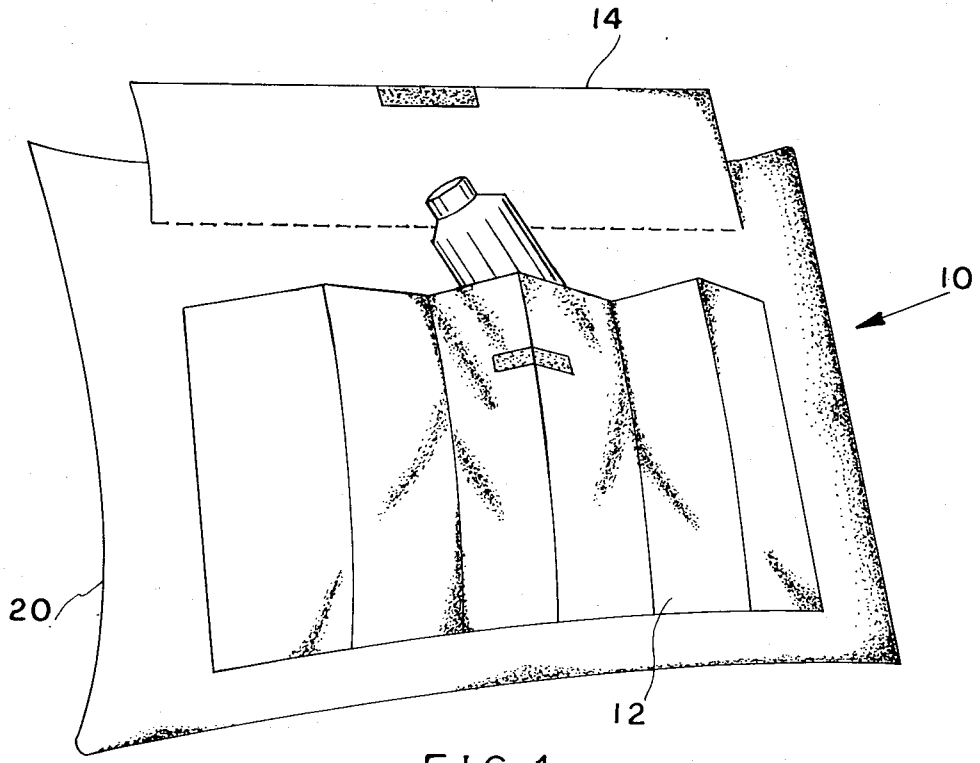
FIG. 1 is a perspective view of the novel pillow.

Referring now to FIG. 1, it will there be seen that the novel pillow is indicated by the reference numeral 10 as a whole; pillow 10 has a plurality of pockets 12 (three in this illustrative embodiment) secured to pillow case 20 by stitches. All seams on pockets 12 and case 20 are double-stitched with polyester thread. A pocket flap 14 is also secured to case 20.

Figure 2:
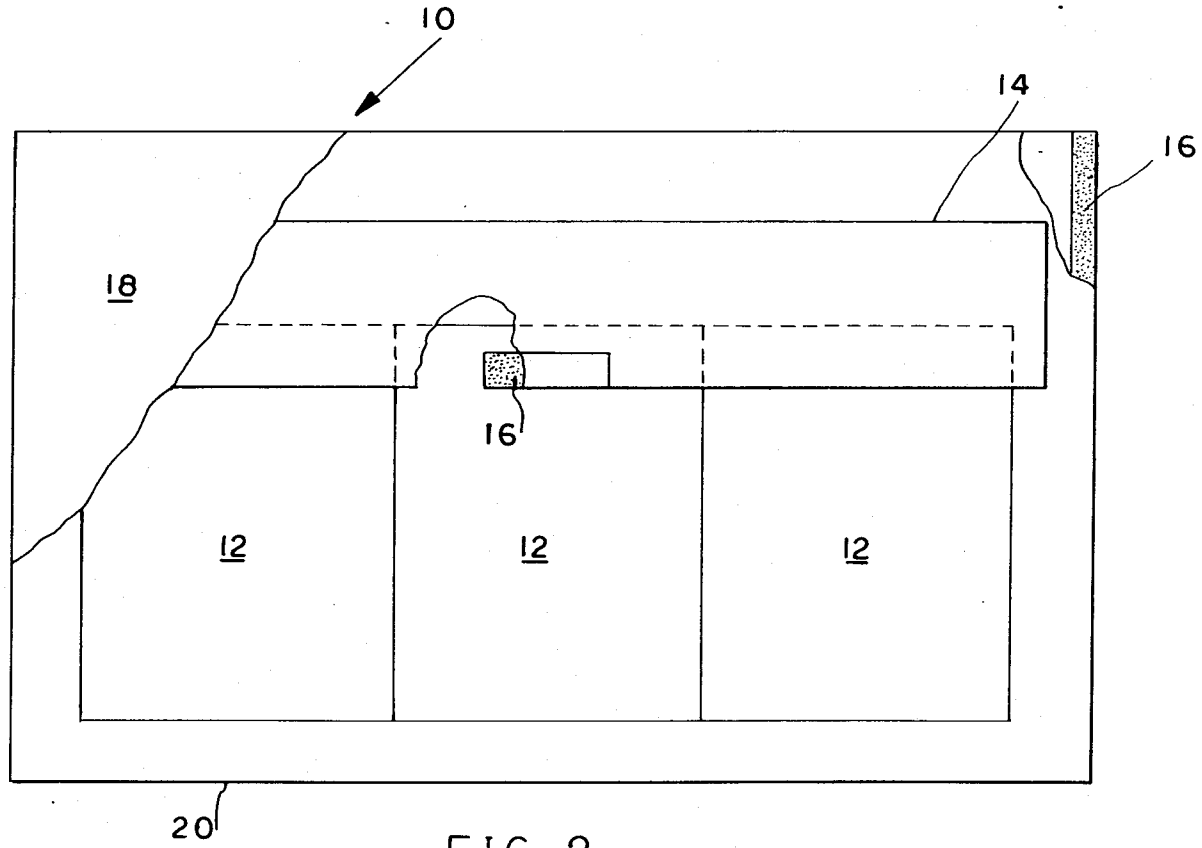
FIG. 2 is a bottom view of the novel pillow with selected parts broken away to show interior details.

FIG. 2 shows additional details of the under side of the novel pillow 10. Case 20 contains a pillow insert 18 made of completely washable polyester material. Case 20 is made of a cotton/polyester preshrunk canvas cloth, which is also completely washable. The pocket flap 14 and the pillow case 20 are sealed with Velcro (trademark) hook and loop type fasteners 16.

Although this embodiment illustrates three pockets in a rectangular pillow made of polyester material, nonetheless, any size, shape, number and material of pockets are within the scope of this invention.

In the illustrative embodiment disclosed herein, the size of the rectangular pillow is $14'' \times 12'' \times 4''$; and the size of one pocket 12 is $4'' \times 6'' \times 2''$.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A pillow having a plurality of concealed storage compartments, comprising:

a pillow case member of generally rectangular configuration;

said pillow case member having a top surface and a bottom surface positioned in registration with one another so that said top surface overlies said bottom surface and respective edges of said top and bottom surfaces are coincident with one another;

said top surface having an outer face and an inner face;

said bottom surface having an outer face and an inner face;

said top and bottom surfaces being fixedly secured to one another along three edges thereof, a fourth edge thereof remaining unsecured and providing an access opening into a cavity means formed by said top and bottom surfaces;

a soft pillow insert member specifically configured and dimensioned to slideably fit within said cavity means;

hook and loop type fastening means fixedly secured to said top and bottom surfaces along the respective inner faces of said fourth, unsecured edges thereof so that said cavity means is accessible attendant separation of said fastening means;

a plurality of laterally aligned pocket members formed on the outside face of said bottom surface of said pillow case member;

an elongate flap member, in the form of a strip of material having an inner and outer face, being fixedly secured to the outer face of said bottom surface of said pillow case member at a position upwardly of said pocket members such that a lower portion of said flap member overlies an upper portion of said pocket members;

said flap member having a transverse dimension substantially equal to the combined transverse dimensions of said pocket members;

said flap member having a hook and loop type fastener secured to an inner face thereof;

at least one of said pocket members having a complementary hook and loop type fastener secured to an outer face thereof;

said single flap member closing said plurality of pocket members when said flap member is folded downwardly over said pocket members;

said pillow member being positioned on a support surface with said top surface facing upwardly to conceal said pocket members from view;

whereby the absence of a handle means insures that said pillow does not call attention to itself and whereby items stored in said pocket members are cushioned.

* * * * *